United States Patent [19]

Bergling et al.

[11] 4,145,953

[45] Mar. 27, 1979

[54] DEVICE FOR FIELD ARTILLERY WEAPON FOR ACHIEVING RAPID AND AUTOMATIZED TRANSPORT OF ROUNDS OF AMMUNITION OR PARTS THEREOF

[75] Inventors: Erik A. Bergling, Brösarp; Arne E. Berglund, Karlskoga, both of Sweden

[73] Assignee: Aktiebolaget Bofors, Bofors, Sweden

[21] Appl. No.: 782,687

[22] Filed: Mar. 30, 1977

[30] Foreign Application Priority Data

Mar. 31, 1976 [SE] Sweden ..... 7603852

[51] Int. Cl.[2] ..... F41F 9/04

[52] U.S. Cl. ..... 89/46

[58] Field of Search ..... 89/45, 46, 40 C, 40 P

[56] References Cited

U.S. PATENT DOCUMENTS

| | | | |
|---|---|---|---|
| 1,267,921 | 5/1918 | Smith | 89/40 P |
| 1,336,926 | 4/1920 | Schneider | 89/40 P |
| 1,371,962 | 5/1921 | Wildrick | 89/40 P |
| 2,499,271 | 5/1945 | Harvey et al. | 89/46 |

FOREIGN PATENT DOCUMENTS 188882 4/1964 Sweden.

*Primary Examiner*—Stephen C. Bentley

*Attorney, Agent, or Firm*—Pollock, Vande Sande & Priddy

[57] ABSTRACT

Apparatus for rapidly feeding an artillery weapon with ammunition, comprising a conveyor assembly removably attached to a lower carriage of the weapon and including an adjustable connection which compensates for elevational and transverse movements of the firearm to maintain rapid loading thereof.

15 Claims, 10 Drawing Figures

DEVICE FOR FIELD ARTILLERY WEAPON FOR ACHIEVING RAPID AND AUTOMATIZED TRANSPORT OF ROUNDS OF AMMUNITION OR PARTS THEREOF

BACKGROUND OF THE INVENTION

The present invention relates to a device for a mobile field artillery piece which has a firearm supported on a lower carriage for achieving rapid and automatized transport of rounds of ammunition or parts thereof from a handling station located at a distance from the weapon to a receiving unit arranged on the weapon such as a loading pendulum, loading tray, etc. It primarily relates to artillery weapons having an upper carriage which is traversable on the lower carriage and in which the firearm is arranged so that it can be elevated.

When firing field artillery, there are often problems involved in carrying out rapid firing and maintaining the firing, because the feed of rounds of ammunition to the weapon constitutes heavy difficult work. In general, it is not very appropriate to provide the weapon with permanent devices for feeding rounds of ammunition, as this would have a detrimental influence on the mobility of the weapon, as in rough terrain.

The present invention is based upon the concept that it should be possible to attach a device for feeding rounds of ammunition to the weapon temporarily, and which can be removed when the gun is being moved, to allow transport of the weapon without its being impeded by such a device.

Particularly as the new device is intended for use on field artillery weapons which have the firearm arranged so that it can be elevated in an upper carriage, which, in turn, can be traversed in relation to a lower carriage, it is necessary that the receiving unit for the rounds or the like comprises, at least as a part function, a loading pendulum which can adapt the transfer of rounds from the conveyor belt to the positions for which the firearm has been set in relation to the lower carriage.

SUMMARY OF THE PRESENT INVENTION

A feature that can be considered characteristic of the present invention is that it comprises a round conveyor arranged so that it can be attached to and removed from at least the lower carriage of the weapon, with the conveyor, in its attached position, having one end attached to the receiving unit, and is then adjustable both to the end of the conveyor and to the firearm, independent of the relative positions of the firearm and the lower carriage.

Further embodiments the invention comprise special designs of and fastening devices in the lower carriage for the conveyor and the round receiving unit so that technically seen comparatively simple and therefore suitable embodiments for use in field service, which do not affect the function of the gun in other respects, can be accomplished.

BRIEF DESCRIPTION OF THE DRAWINGS

A preferred embodiment of the present invention will be described in detail in the following, with reference to the accompanying drawings, in which.

Figure 5:
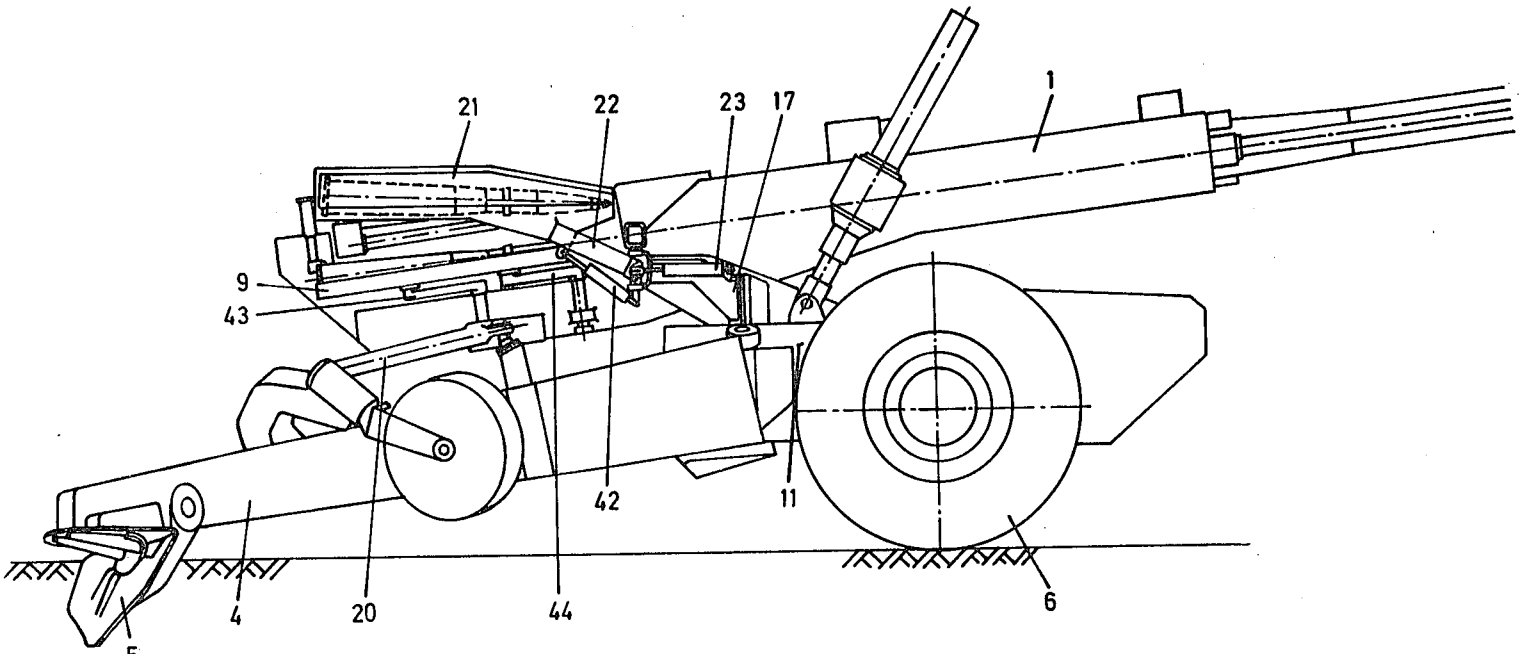
FIG. 5 shows from the side a loading pendulum utilized by the field artillery weapon according to FIG. 1.
Figure 7:
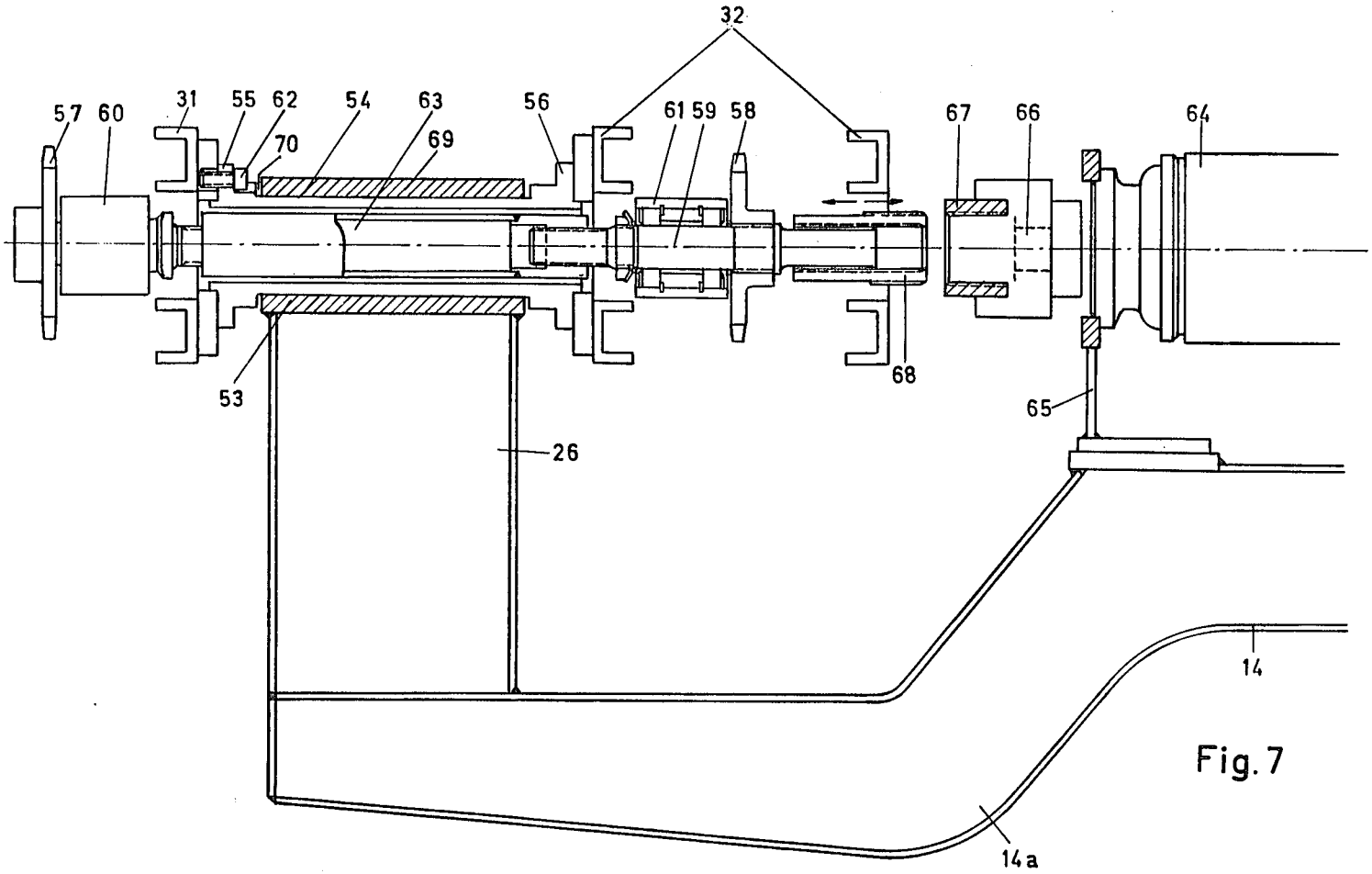

FIGS. *6a–6b* show vertical and horizontal views of the loading pendulum shown in FIG. 5 in greater detail;

FIG. 7 shows a vertical view, and a partly cross-section view of the supporting and driving members for the conveyor according to FIGS. 1–4; and FIGS. *8a–8b* show a vertical view, a cross-section view and an end view, respectively, of the parts comprised in the conveyor according to FIGS. 1–4.

DETAILED DESCRIPTION OF A PREFERRED EMBODIMENT

Figure 1:
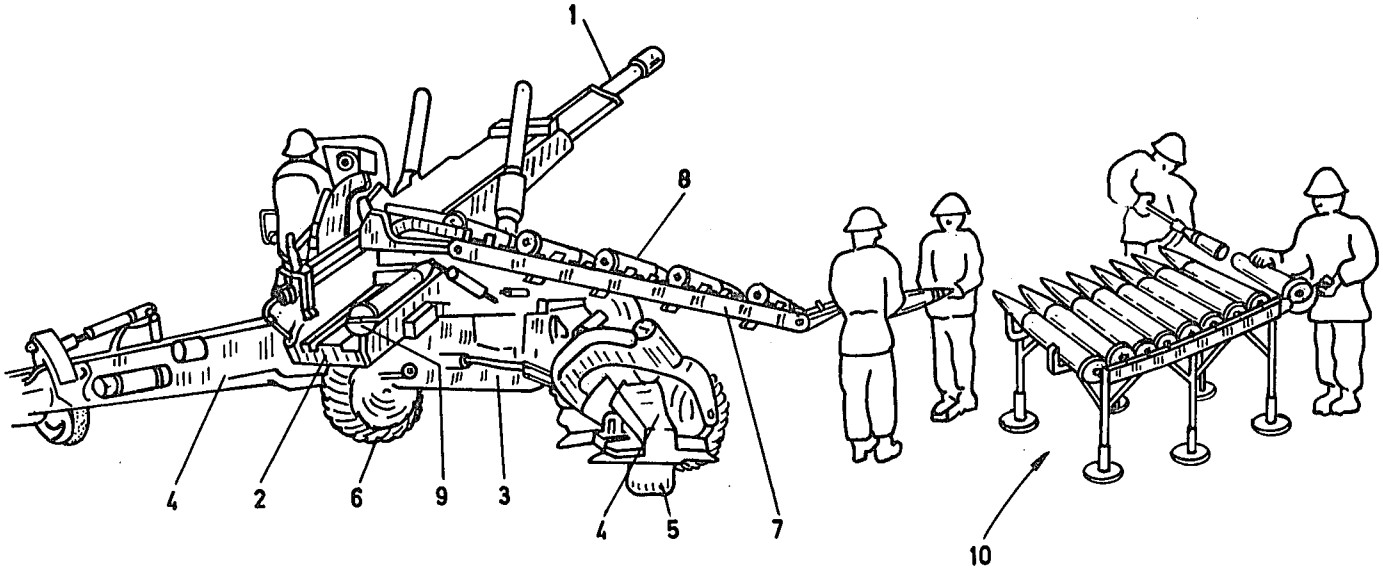
FIG. 1 shows a field artillery weapon in perspective and obliquely from the rear utilizing the invention and in firing position.

The field artillery weapon shown in FIG. 1 is of the kind comprising a firearm arranged on a lower carriage with a barrel 1 and a cradle 2. The firearm is then suspended in a known way so that it can be elevated in an upper carriage, which, in turn, in a known way can be traversed on the lower carriage. The lower carriage comprises a chassis 3 and two carriage trails 4 extending therefrom, and which are spread and have been secured to the ground by means of trail spades 5. The gun runs on wheels, and is therefore provided with a pair of driving wheels 6, with a pivot wheel arranged so that it can be raised and lowered on each carriage trail 4, and which pivots freely.

A conveyor 7 for rounds of ammunition 8 is connected to the weapon at its right carriage trail, to both the upper and lower carriages, as will be noted from the following. At the cradle 2, a loading tray 9 is arranged, which follows the elevating mass, and which can be displaced laterally from the lateral position shown in FIG. 1, to a position where it is swung in behind the firearm in the extension of the axis of the bore, which is not shown. Because the firearm can be elevated and traversed in relation to the lower carriage, at the inner end of the conveyor, the weapon is provided with a loading pendulum, not shown in detail in FIG. 1, which transfers the round from the conveyor, which is partly fixed in relation to the lower carriage of the weapon, to the firearm and therewith to the various settings of the loading tray.

In connection with the conveyor an assembling table 10 is set up, on which shells and cartridge cases can be assembled at one end and removed at the other end. The transport device according to the invention achieves the transport of rounds from the depositing shelf 10 at the end of the conveyor facing the direction away from the weapon to the position in the loading tray 9. The invention also includes embodiments in which the functions of the loading pendulum and the loading tray are built together in one way or another.

Figure 2:
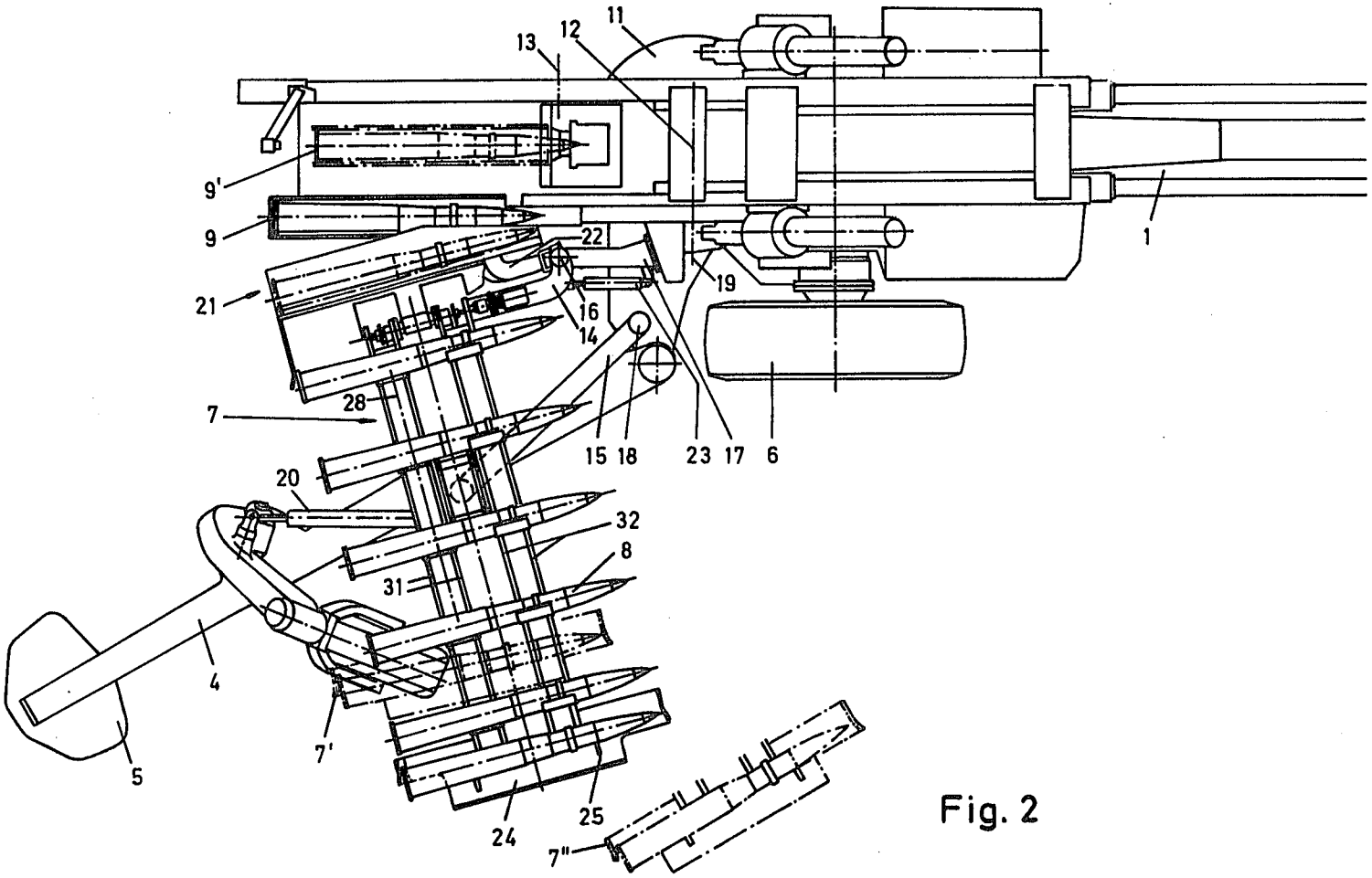
FIG. 2 shows a horizontal view of the weapon according to FIG. 1.

FIG. 2 shows the suspension of the conveyor 7 on the upper and lower carriages, with the upper carriage being partly shown and designated 11 and the upper carriage and therewith the pivoting centre of the firearm being designated 12. Behind said pivoting centre, the trunnion centre 13 of the firearm, for elevation, is indicated. The conveyor 7 is supported on two arms, the first arm being designated 14, and referable to the upper carriage, while the second arm is designated 15 and is referable to the lower carriage. The first arm 14, in turn, is rotatably supported on a first supporting axle 16, which extends at right angles to the plane of the paper in FIG. 1, and extends vertically thereto. The first supporting axle 16 is supported in a part 17, which is fixed in relation to the upper carriage 11. The first supporting arm 14 is fixed to the conveyor at the inner end thereof. The second supporting arm 15 is supported on the lower carriage 19 via a second supporting axle 18 extending parallel to the first supporting axle 16 and which is, in turn, supported by a part of the lower carriage 19. The second arm 15 coacts with a central portion of the conveyor. As the weapon traverses, the conveyor 7 turns in its supporting plane for rounds, whereby at the maximum field of traverse of the firearm the free ends of the table will be displaced between the positions indicated by 7' and 7'' at the same time as the longitudinal axis of the conveyor 7 changes its angle in relation to the longitudinal direction of the firearm.

In FIG. 2, the swung-in position of the loading tray 9 has been indicated by 9', and an operating cylinder for the pivot wheel of the right carriage trail 4 has been designated 20. The loading pendulum mentioned above has the designation 21, and its pendulum arm has been designated 22.

Pendulum arm has been given two operating cylinders, of which the first operating cylinder 23, as shown by FIG. 2, controls the movement of the pendulum in traverse, and the second pendulum arm, which is not shown in the same figure, controls the angle of elevation of the pendulum. At the end of the conveyor facing away from the weapon, the conveyor is made with a feeding part 24 with blocking members 25 for the rounds.

Figure 3:
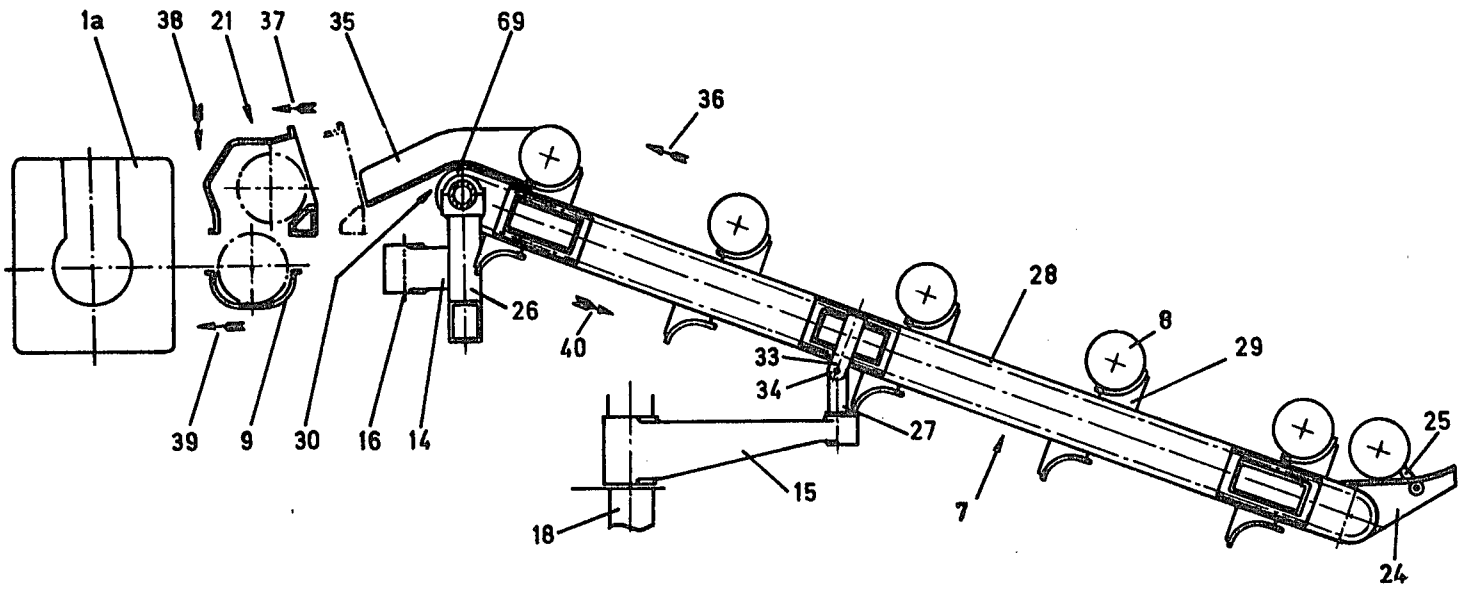
FIG. 3 shows from the side a conveyor according to the invention which has a first inclined position shown in FIG. 1.
Figure 4:
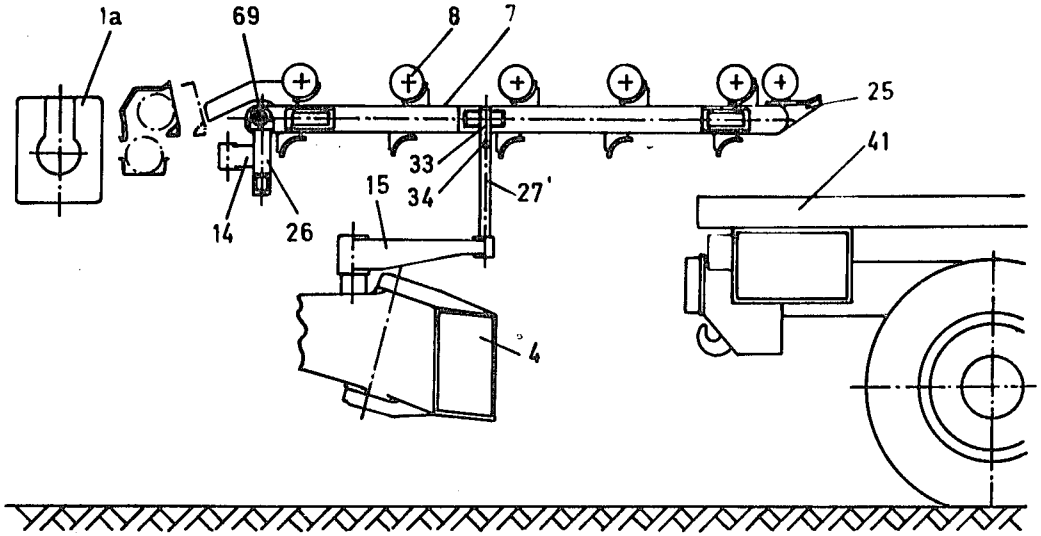
FIG. 4 shows from the side the conveyor according to FIG. 3, but in a second inclined position.

FIG. 3 shows the function, in principle, of the conveyor 7, and its fastening in relation to the loading pendulum 21, loading tray 9, and the breech ring 1*a* of the barrel. The first arm 14, at its end coacting with conveyor, a first support 26, and the second arm 15, at its end coacting with conveyor 7 a second support 27. The conveyor is chain driven, and is provided with two longitudinal chains, one of which is symbolized by 28. Each chain is provided with a number of carriers 29. The driving devices 30 for the chain are located at the inner end of the conveyor. There is a pair of guide rails for each chain and, as shown in FIG. 2, the pairs of guide rails for the two driving chains have been given the designations 31 and 32, respectively. The second supporting part 27 coacts with the conveyor via a yoke 33, to which the second supporting part 27 is rotatably supported in a supporting device 34. In addition to the depositing shelf 24 for the rounds at the outer end of the conveyor, the conveyor 7 belt is provided with a deflecting part 35 for the rounds 8 and the inner end.

The transport of rounds by means of the conveyor takes place as indicated by the arrow 36 in FIG. 3, with the round 8 moving from the outer end of the conveyor 7 to its inner end, where the movements of the loading pendulum are indicated by 37 and 38. The lateral movement of the loading tray 9 is indicated by the arrow 39, and the return movement of the carriers 29 by the arrow 40.

FIG. 3 is also intended to show the case where personnel standing on the ground are to apply the rounds on to the depositing shelf part 25 of the conveyor. However, as will be noted from FIG. 4, the rounds can also be fed from a truck 41 and the like. In this case, the transport of rounds takes place in the corresponding way as described above. The conveyor 7 has been raised by changing the second support part 27' which, in this case, has been formed with a greater length. In order to achieve different inclinations of the conveyor 7, the second support part 27 has been detachably fastened in the second arm 15. The detachability can be achieved by means of locking screws or corresponding securing devices.

FIG. 5 shows the fastening, in principle, of the loading pendulum 21, and in addition to the first operating cylinder 23 for the traversing of the pendulum, the operating cylinder 42 for the angle of elevation of the pendulum is shown. Likewise, the suspension of the loading tray 9 in two parallel arms 43 and 44 is shown, which in a conventional way are rotatably supported at their both ends on the under side of the tray 9 and in the elevating mass.

Figure 6A:
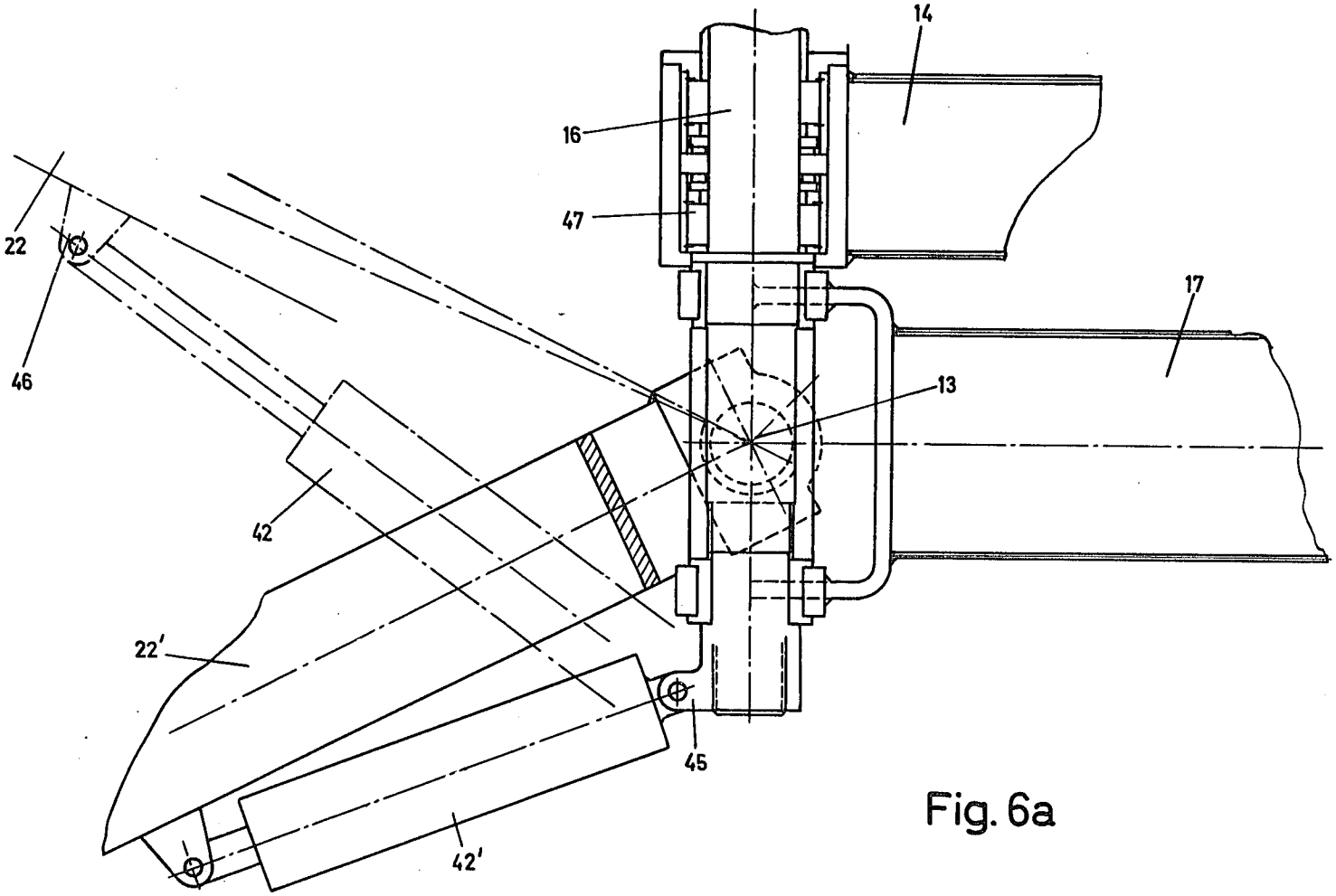
Figure 6B:
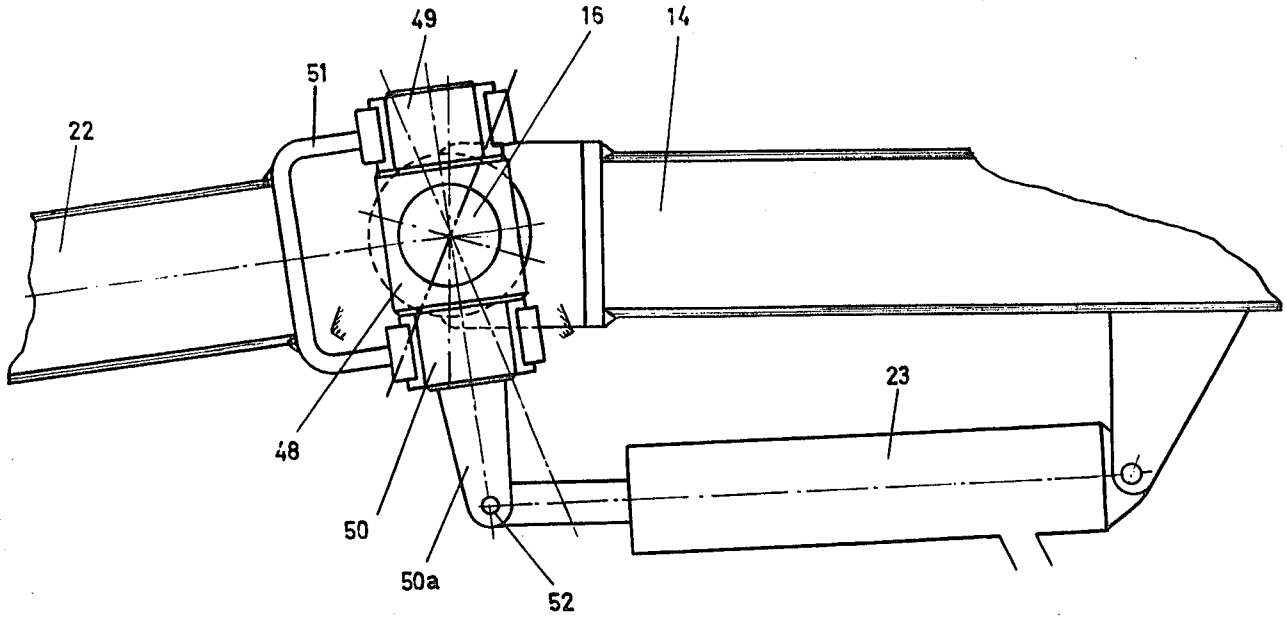

In FIGS. 6*a* and 6*b* the arrangement of the first supporting axle 16 is shown. Supporting axle 16 is rotatably supported in or at the elevating trunnion in question, and comprises a universal joint for the pendulum arm 22, which can be turned between the elevation positions designated 22 and 22' in FIG. 6*a* by means of the operating cylinder, the corresponding positions of which have been designated 42 and 42'. The operating cylinder 42 is fastened in a rotatable support 45 at the lower end of the supporting axle 16, and in a rotatable support 46 on the under side of the pendulum arm 22. The supporting axle 16 is rotatably supported in the part 17 and also in the arm 14 via a supporting device 47, which permits the turning between the supporting axle 16 and the arm 14.

The universal joint for the pendulum arm 22 comprises a fixed unit 48 arranged on the supporting axle 16 which supports two journals 49 and 50 extending away from each other, in which the pendulum arm 22 is rotatably supported via a yoke 51. One of the journals 50 is extended, and in the extension 50*a* the operating cylinder 23 is fastened in a rotatable support 52. At its other end, the last-mentioned operating cylinder is rotatably supported in the arm 14.

As will be noted from FIG. 7, the first arm 14 is made with a part 14*a* which is inwardly curved, and at its free end supports the first supporting part 26. On its upper side 53, the first supporting part 26 has a supporting member 54, in the form of a hollow cylinder. At its ends, the hollow cylinder 54 is provided with flanges 55 and 56. In principle, the conveyor 7 is divided into two units, each of which comprises a driving wheel 57 and 58, respectively, and one of the previously mentioned pairs of guide rails 31 and 32, respectively, of which only one of the guide rails in the pair of guide rails 31 is shown in FIG. 7. Each unit, respectively, also comprises a drive chain (38 in FIG. 2) and at the other end of this a chain wheel, not shown, is arranged. The drive wheels 57 and 58, respectively are arranged on a shaft 59 which is supported in a bearing 60 which is mounted on the frame of the conveyor. At the upper end of the conveyor, the respective unit is connected with the flanges 55 and 56 of the supporting member 54, by means of a number of screws 62 or the like, of which only one is shown in the figure. In the supporting member 54 a part shaft 63 is arranged, which is made with square recesses or the like at its ends, in which recesses the ends of the drive wheel shafts 59 in the units can be inserted, so that a rigid connection between the parts of the shafts can be obtained. FIG. 7 is intended to show the parts of the shafts in a connected condition.

On the part of the arm 14 which is located above the part 14*a* which is inwardly curved, a driving motor 64 is positioned for driving the driving wheels 57 and 58 attached to the chains. The motor 64, which preferably comprises a hydraulic motor, is arranged in a support 65, so that its output shaft 66 coincides with the above-mentioned part shafts which are connected together. On its shaft 66, the hydraulic motor 64 has a first connection part 67, with which a second connection part 68 on the shaft 59 for the driving wheel can be connected, so that a rigid connection can be obtained between the parts of the shaft which are connected together and the output shaft of the motor. In FIG. 7, the connection parts 67 and 68 are shown in a separated position. The conveyor is secured to the part 53 of the support 26 by means of a clamp 69 which is fastened in the part 53 at its ends by means of nuts or the like, which are not shown. The clamp has a semi-circular cross-section, and straight flanges connected to its ends, which have holes for the fastening screws. In the upper part 53, the support 26 has threaded holes for the screws. The supporting member 54 is made with an outer recessed portion 70, via which the clamp 69 secures the supporting member in its longitudinal direction and, therewith, the conveyor in its transversal direction.

Figures 8A, 8B:
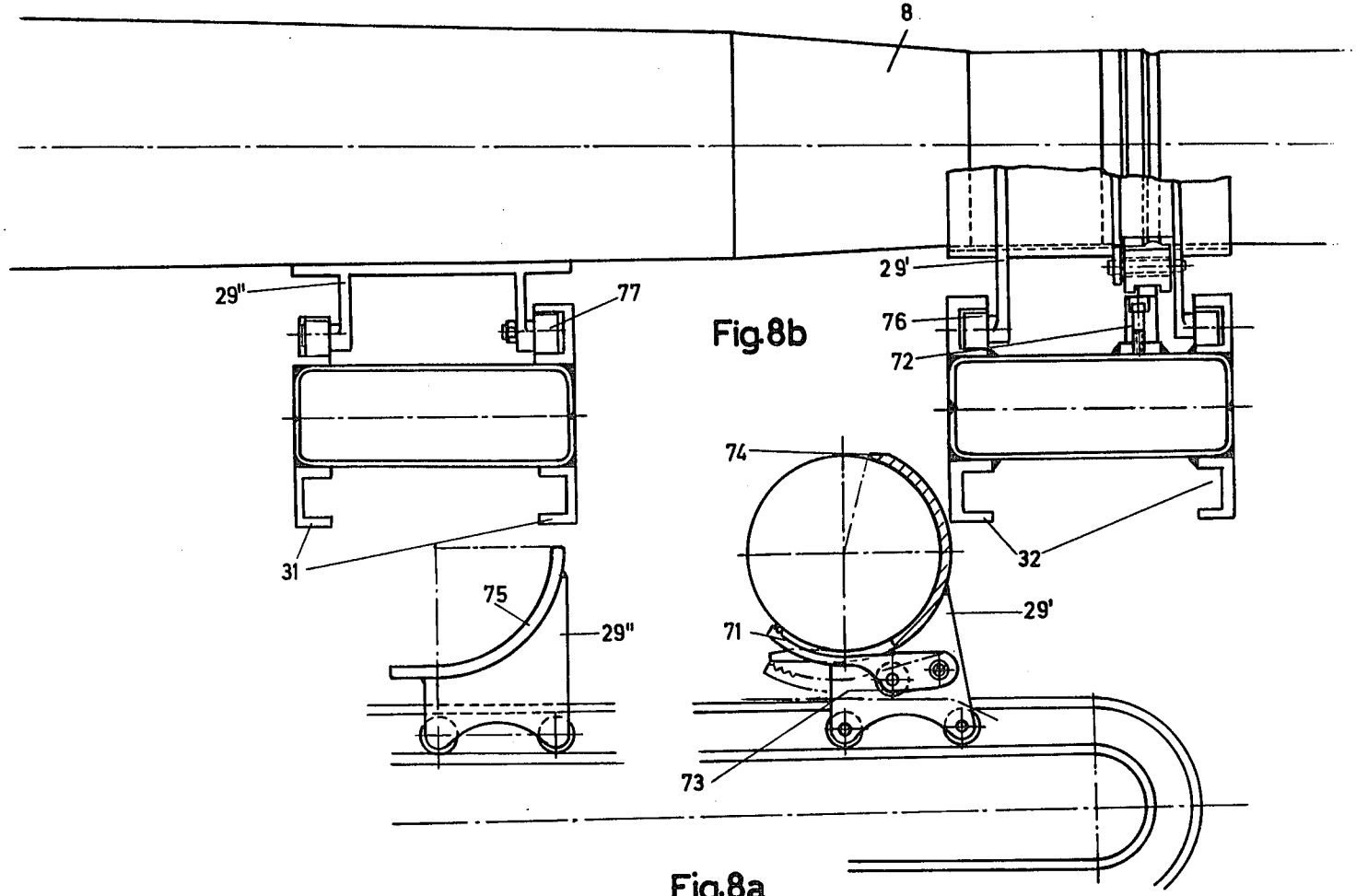

When removing the conveyor, the connection parts 69 and 70 are thus disengaged from their connected position so that the connection between the shaft parts ceases. Thereafter the clamp 69 is disengaged from its connection with the support 26. After the disactivation of the connection of the conveyor to the second support part 27 (FIG. 3) the conveyor can easily be removed, as one single unit, from the field artillery weapon. The conveyor is attached in, in principle, the reverse order. FIGS. 8*a* and 8*b* show the operation of the carriers 29, which are arranged so that they can be guided in the pairs of guide rails 31 and 32 by means of the chains, to which they are secured at a distance from each other. The number of carriers is chosen in dependence on the length of the conveyor and the diameters of the rounds. The carrier 29' in the pair of guide rails 32 has a design which differs somewhat from the design of the carrier 29" in the pair of guide rails 31, in that, in addition to their strictly carrying function, they also have a gripping function. This gripping function is achieved by means of gripping fingers 71, which are known in themselves, the position of which is determined by means of guide lugs and/or strips 72 arranged in the track which can coact with a wheel 73 on the respective gripping finger. The supporting section 74 which coacts with the round has a greater extent on the carrier 29' than the corresponding section 75 on the carrier 29". The guide rails in the respective pairs of guide rails are made from U-shaped beams, in the recesses of which the carriers slide on wheels 76 and 77, respectively.

The invention is not limited to the embodiment shown above as an example, but can be subject to modifications within the scope of the following claims. In the above-mentioned example, a conveyor for complete rounds has been shown, but it is also possible to transport, for instance, only the shells to the loading tray 9 or corresponding parts by means of the conveyor, and thereafter carry out the assembling of the rounds or the like in connection with the ramming procedure. The conveyor is thus also suitable for use for projectiles or shells which coact with separate loading propellant charges or the like.

We claim:

1. A device for rapidly and automatically positioning a projectile into a loading mechanism of an artillery weapon of the type including a firearm movably supported in a carriage assembly, comprising:

an endless conveyor assembly having a first end positionable adjacent said loading mechanism and a second end remote therefrom, with said conveyor transporting said projectile from said second to said first end;

releasable attachment means extending between said conveyor and said carriage assembly, with said attachment means adjusting to any movement of said carriage assembly relative to said conveyor caused by operation of said firearm;

pendulum means attached to said artillery weapon for transporting said projectile from said conveyor to said loading mechanism, with said pendulum means compensating for movement of said loading mechanism relative to said conveyor to ensure correct positioning of said projectile;

said pendulum means comprising a support member pivotally attached to said carriage assembly to transport a projectile from said conveyor assembly to said loading mechanism;

said pendulum means further comprising a pendulum arm attached at one end to said support member and at an opposite end to a universal joint assembly;

with a further arm assembly attached at one end to said carriage assembly and attached at an opposite end to said universal joint, allowing said pendulum arm to pivot in two directions relative to said support arm.

2. An assembly according to claim 1, wherein said carriage assembly comprises separate upper and lower carriage assemblies;

said firearm being arranged in said upper carriage, with said upper carriage being traversable and pivotable relative to said lower carriage.

3. An assembly according to claim 2, wherein said attachment means is simultaneously releasable from both said carriage assemblies.

4. An assembly according to claim 1, wherein a plurality of operating cylinders extend between said pendulum arm and said carriage assembly for pivoting said support member relative to said conveyor and said loading mechanism.

5. An assembly according to claim 2, with said attachment means comprising:

a first connecting arm attached at one end to said conveyor and at an opposite end to a first support axle mounted on said upper carriage and extending at right angles to an elevating trunnion of said firearm;

a second connecting arm attached at one end to said conveyor and at an opposite end to a second support axle mounted in said lower carriage and extending parallel to said first axle;

whereby said first and second arms pivot about said respective axles to move said conveyor relative to said weapon to ensure proper alignment of said conveyor with said firearm.

6. An assembly according to claim 5, wherein said first support axle forms a portion of a universal joint comprising a portion of a cylinder attached at one end to said support axle and at an opposite end to said pendulum means for rotating said pendulum means relative to said axle and elevate a projectile relative to loading mechanism.

7. An assembly according to claim 6, wherein said first and second connecting arms are each attached to a central portion of said conveyor assembly.

8. An assembly according to claim 6, wherein said first arm includes a curved portion formed adjacent said conveyor, with a support extending between said curved portion and said conveyor to provide support therefore.

9. A device according to claim 8, wherein a drive shaft is positioned within a hollow tube mounted on said conveyor and attached to said support via a clamp assembly.

10. An assembly according to claim 9, wherein said first connecting arm further supports a driving motor selectively attached to said drive shaft for joint rotation;

said drive shaft having at least two drive wheels mounted for rotation therewith with each wheel attached to a separate chain assembly extending through said conveyor;

whereby operation of said driving motor causes said drive shaft and said drive wheels to jointly rotate, moving said chain relative to said conveyor.

11. An assembly according to claim 10, wherein a pair of guide rails are mounted on either side of each chain assembly.

12. An assembly according to claim 11, wherein said hollow tube includes an external recess which is engaged by said claim assembly;

with said drive wheels being mounted on either side of said hollow tube.

13. An assembly according to claim 11, wherein each of said drive wheels and associated guide rails are independently removable from said conveyor assembly as required.

14. An assembly according to claim 5, wherein a rod member extends from said conveyor and is releasably attached to said second connecting arm, whereby said rod member is movable to change the inclination of said conveyor relative to the ground.

15. A device according to claim 1, wherein a deposit shelf is attached to the remote end of said conveyor for positioning said projectiles thereon.

* * * * *